US005572929A

United States Patent [19]

Lacy

[11] Patent Number: 5,572,929

[45] Date of Patent: Nov. 12, 1996

[54] ROOM JACKET FOR PATIENT IDENTIFICATION CARD

[75] Inventor: Rodney G. Lacy, 1221 Heatherton Dr., Naperville, Ill. 60563

[73] Assignee: Rodney G. Lacy, Naperville, Ill.

[21] Appl. No.: 490,672

[22] Filed: Jun. 15, 1995

[51] Int. Cl.[6] ..... B41L 47/02

[52] U.S. Cl. ..... 101/368; 101/369

[58] Field of Search ..... 101/368, 369, 101/407.1, 474; 40/649, 651, 653

[56] References Cited

U.S. PATENT DOCUMENTS

| | | | |
|---|---|---|---|
| 1,808,007 | 6/1931 | Schaefer | 101/382.1 |
| 1,847,838 | 3/1932 | Krell | 101/382.1 |
| 1,858,480 | 5/1932 | Chisholm | 101/368 |
| 2,072,588 | 3/1937 | Kubalanza | 101/369 |
| 2,076,474 | 4/1937 | Luckie | 101/369 |
| 2,080,417 | 5/1937 | Gollwitzer | 101/369 |
| 2,710,407 | 6/1955 | Hueber | 101/369 |
| 2,902,925 | 9/1959 | Wagner | 101/368 |
| 2,935,941 | 5/1960 | Bradford | 101/369 |
| 3,379,130 | 4/1968 | Korfmann | 101/369 |
| 4,048,737 | 9/1977 | McDermott | 40/649 |
| 4,356,646 | 11/1982 | Johnson | 101/369 |
| 4,817,316 | 4/1989 | Walker | 40/649 |
| 5,197,387 | 3/1993 | Lacy | 101/368 |

FOREIGN PATENT DOCUMENTS

| | | | |
|---|---|---|---|
| 0745767 | 5/1933 | France | 101/369 |

*Primary Examiner*—Edgar S. Burr
*Assistant Examiner*—Anthony H. Nguyen
*Attorney, Agent, or Firm*—Hill, Steadman & Simpson

[57] ABSTRACT

A card holder jacket holds an identification card that has raised indicia. The card holder jacket has an indicia portion on which raised indicia are formed for imprinting at the same time that an imprint is made of the indicia on the card. The card holder jacket extends beyond the edges of the card and have dome shaped slit forms that engage three edges of the card. A raised lip and raised edge at the indicia portion engage the fourth edge of the card. The card holder jacket has openings that are placed over a universal card holder in the imprinter apparatus, and stabilizer flaps that extend downward to engage the outer side of the universal card holder.

14 Claims, 4 Drawing Sheets

ROOM JACKET FOR PATIENT IDENTIFICATION CARD

BACKGROUND OF THE INVENTION

1. Field of the Invention

The present invention relates generally to a support plate carrying indicia for use as a backing with an identification card for imprinting and in particular to a so-called room jacket or card jacket as a backing for patient identification card in a medical facility.

2. Description of the Related Art

Identification cards are commonly used to identify patients in hospitals and medical facilities. The identification cards have raised lettering with patient identification information. An imprint of the patient card are made on a treatment record when a treatment is given so that a positive identification of the patient is marked on the treatment record. This facilitates record keeping and billing in the hospital or medical facility.

It is desirable to track the patient room information in the patient records, as well. As such, the identification card may be embossed with the room number. However, patients may be moved from one room to another, often as many as 3 to 5 times in a single hospital stay. This results in the wasteful practice of the embossed card being disposed of each time the patient changes rooms.

For room identification purposes, it is becoming common to provide a so-called room jacket which has the room identification number as raised indicia thereon and from which an imprint can be made at the same time as the imprint of the patient identification card. One type of known room imprint plate is of plastic with a tab along the top that is embossed with the room number. The identification card is placed on the room jacket for imprinting. The plastic room jacket wears down and/or breaks with repeated use, requiring replacement every few months.

Metal room jackets which hold the identification cards have been used with limited success. In particular, any misalignment of the card on the jacket by rushed medical staff may lead to bending of the jacket, thereby making it unusable. While measures have been taken to cure this problem, another problem remains, namely, the heavily embossed patient cards are warped and do not stay in place on the room jacket during imprinting. Also, the movement of the imprint roller over the room jacket and patient card squeezes them and causes the room jacket to slip out of place and even flip out of the imprint device.

A known room jacket is disclosed in U.S. Pat. No. 5,197,387.

SUMMARY OF THE INVENTION

An object of the present invention is to provide a card holder jacket that engages the imprint anvil and/or card holder and is thereby held in place during the imprinting operation.

Another object of the present invention is securely engage the identification card so that it stays in the room jacket when desired, yet is readily removable therefrom.

A further object of the present invention is to accommodate perpendicular movement of the room jacket on the imprint anvil during imprinting while preventing lateral shifting.

These and other objects and advantages of the present invention are achieved in a card holder jacket, or room jacket, having openings through which a universal card holder can extend to engage the identification card placed atop the room jacket. The universal card holder can move freely up and down through the openings as the impression ink roller passes thereover.

The edges of the room jacket extend laterally beyond the edges of the identification card and beyond the universal holder openings to further stabilize the room jacket during movement of the impression roller thereover and thereby prevent late pressure flipping of the room jacket and identification card from the imprinting apparatus.

A preferred embodiment of the room jacket has stabilizers that extend downward alongside the universal card holder to hold the room jacket in place and prevent shifting as the impression is made.

DETAILED DESCRIPTION OF THE PREFERRED EMBODIMENTS

Figures 1, 2, 3, 4, 5, 6, 7:
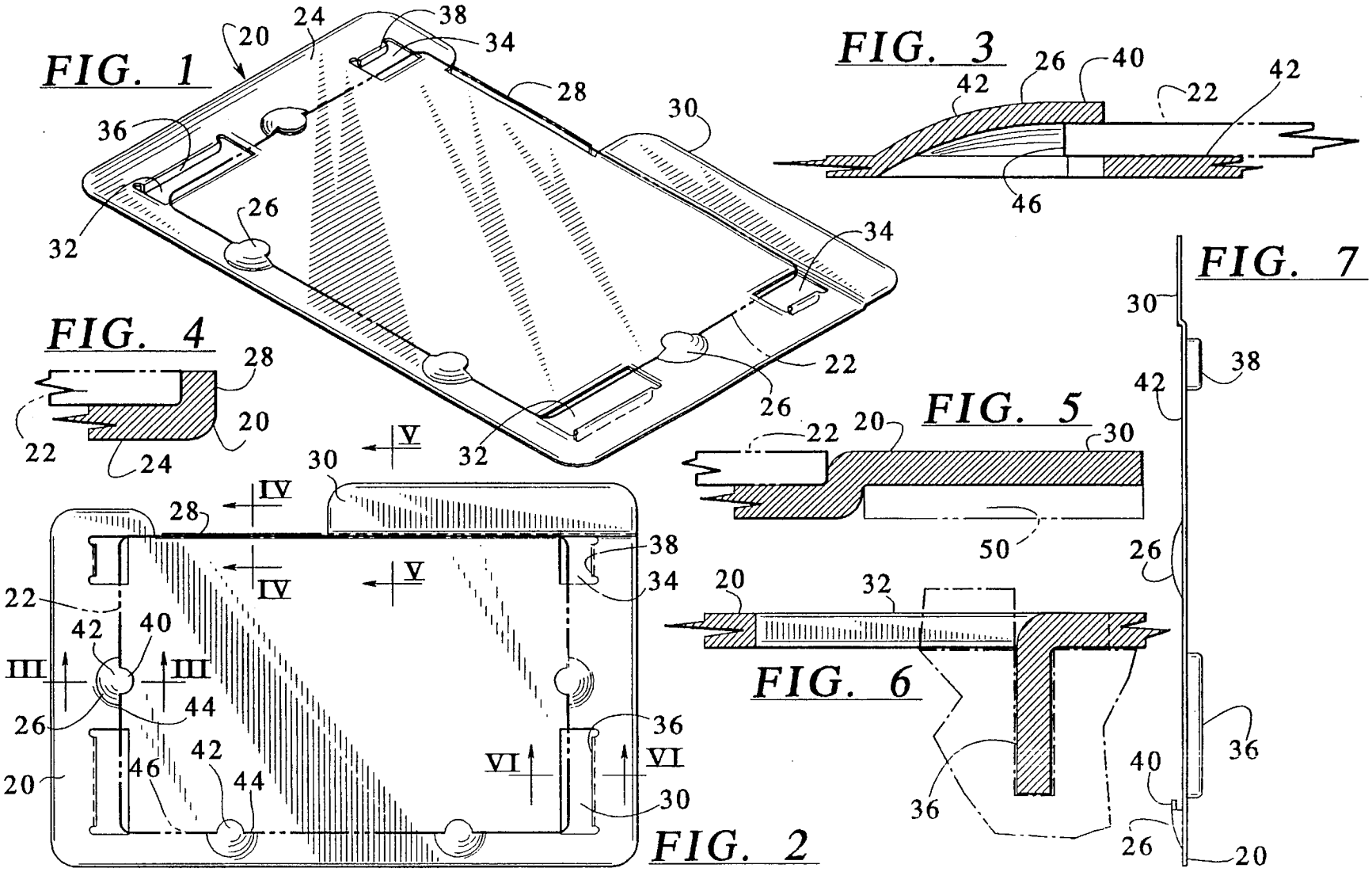
FIG. 1 is a perspective view of a first embodiment of the present room jacket according to the principles of the present invention.
FIG. 2 is a plan view of the room jacket of FIG. 1.
FIG. 3 is an enlarged, fragmentary cross section along lines III—III of FIG. 2 showing a card edge holding slit form.
FIG. 4 is an enlarged, fragmentary cross section along lines IV—IV of FIG. 2 showing an edge engaging lip on the room jacket.
FIG. 5 is an enlarged, fragmentary cross section along lines V—V of FIG. 2 showing a room identification portion.
FIG. 6 is an enlarged, fragmentary cross section along lines VI—VI of FIG. 2 showing the stabilizer portion.
FIG. 7 is a side view of the edge of the present room jacket of FIGS. 1 and 2.

Referring first to FIG. 1, the present invention provides a so-called room jacket, or card holding jacket, 20 which serves as a backing plate for an identification card in an imprinting apparatus for taking an imprint of both the identification card 22 (shown in dotted outline) and the room jacket 20. The identification card 22 to be used in the present room jacket has raised, or embossed, letters and/or numbers thereon of which imprints are made. For example, a patient's name, address, medical records number, and other information may be embossed on the identification card 22. This information is imprinted on medical records forms by placing the records form atop the card and moving an inked roller thereover using an imprinting apparatus. The room jacket 20 includes location indicia that indicates the location of the patient when the medical records imprint is made. The room jacket 20 is switched from card to card as patients move from room to room.

In general, the room jacket 20 includes a planar body 24 of metal that is cut and formed to hold the identification card 22 when it is placed in an imprinting apparatus. In the preferred embodiment, the metal body 24 is of magnetically responsive #430 stainless steel of a thickness of 0.020 inches (0.508 mm). This thickness of material is sufficient to resist deformation and curl that have characterized earlier 0.015 inch thick metal room jackets. In addition, the magnetically responsive material may be held to the imprinting anvil by a magnet so as to better resist dislocation.

The room jacket 20 engages and holds the identification card 22 in a plurality of slit forms 26. In the illustrated embodiment, the slit forms 26 are provided on three sides of the identification card 22, one slit form 26 being provided at each lateral edge of the identification card 22 and two slit forms 26 being provided at the lower edge of the identification card 22. The top edge of the identification card 22 is engaged by, on one hand, a raised lip 28 at an open portion at the edge of the room jacket 20 and, on the other hand, by a raised edge at a room identification portion 30. The room identification portion also referred to as a raised tab, 30 is to be embossed with the indicia that is imprinted when imprinting the indicia of the identification card 22, and so the room identification portion 30 is raised above the plane of the planar body 24 to a level approximately level with the top surface of the identification card 22 when it is in place on the room jacket 20.

The features described so far relate to supporting the identification card 22 on the room jacket 20. The room jacket 20 also includes features for supporting itself and the identification card 22 on an imprinting apparatus. In particular, a plurality of openings 32 and 34 are provided in the room jacket 20. The first openings 32 are elongated while the second openings 34 are generally square in the illustrated embodiment. The openings 32 and 34 are arranged near the edges of the identification card 22 and are positioned so that a card holder, such as the universal card holder (as described in further detail hereinafter), extends through the openings 32 and 34 and engages the edges of the identification card 22. Since the universal card holder extends through the openings 32 and 34, the room jacket 20 is prevented from moving out of position as an imprint roller moves thereover. Proper room jacket and patient card position is thereby maintained for even multiple imprint copies.

For additional positional support, stabilizers 36 and 38 are provided at the openings 32 and 34, respectively. The stabilizers 36 and 38 are in the form of flaps cut free by the formation of the openings 32 and 34 and are bent down from the edges of the openings 32 and 34. The stabilizers 36 and 38 engage the universal card holder and extend through the openings in the impression anvil to prevent dislocation of the room jacket 20. The upwardly projecting fingers of the universal card holder flex downward as the imprinting roller moves thereover, so the stabilizers 36 and 38 act to maintain the position of the room jacket 20 even when the universal card holder no longer extends through the openings 32 and 34.

FIG. 2 shows the relative positions of the elements of the present room jacket 20. The identification card 22 which fits in the present room jacket 20 is approximately 3.375±0.100 inches (8.5725±0.254 cm) wide by 2.125±0.100 inches (5.3975±0.254 cm) high. The relative positions of the slit forms 26, raised lip 28, and room identification portion 30 are provided accordingly. Identification cards of other measurements may be used in a room jacket 20 according to the invention by forming room jacket 20 with the positions of the slit forms 26 at the edges of the differently sized identification cards 22. The same room jacket blank can be used. The openings 32 and 34 are large enough to accommodate the differently sized card, and the raised lip 28 and the room identification portion 30 also remains substantially unchanged.

FIG. 3 provides a side cross-sectional view of the slit form 26. The slit form 26 caps the identification card 22 with a rounded tab 40 that extends over the top of the card 22. The height of the rounded tab 40 from the card supporting surface 42 corresponds to the thickness of the identification card 22. The rounded tab 40 is at the peak of a dome shaped projection 42, which is formed in the planar body 24 by pressing upward from the underside. The dome shaped projection 42 is generally hemispherical in plan view, being cut free of the planar body 24 generally at its diameter, except for the rounded tab 40 which is also cut from the planar body 24. A cut edge 44 of the dome shaped projection 42 on either side of the rounded tab 40 provides a stop against which an edge 46 of the identification card 22 abuts.

The dome shape of the slit form 26 serves to ease the transition of the imprinting roller of the imprinting apparatus as it moves across the room jacket 20 and across the identification card 22, providing a ramped or beveled edge. This ramped edge lifts the imprinting roller so that the identification card 22 is less likely to be forced out of its position in the room jacket 20. The dome shaped slit form 26 also resists deformation by the pressure exerted on it by the impression roller, even when no card is present or, in a worst case, when the card is positioned on top of the slit form 26 rather than beneath the rounded tab 40.

The slit form 26 is positioned at three sides of the identification card 22 and preferably two such slit forms 26 are at the long side of the card. The arrangement of the slit forms 26 are easily changed to adapt to different identification card shapes and sizes and thicknesses merely by punching a new room jacket 20 with the new positions of the slit forms 26 into a standard room jacket blank.

The fourth, or top, edge of the identification card 22 is held by abutting against the raised lip 28, as shown in greater detail in FIG. 4. The raised lip 28 is formed by bending the edge of the planar body 24 upward. The height of the raised lip 28 corresponds to the thickness of the identification card 22. Since the raised lip 28 does not extend over the top surface of the identification card 22, the card can be removed from the room jacket 20 starting at the top edge. The card is inserted into the room jacket 20 by gripping the top edge thereof and inserting the bottom and side edges into the slit forms 26 first before moving the top edge into abutting relation with the lip 28.

As shown in FIG. 5, the room indicia portion 30 is raised above the surface of the planar body 24, and preferably is raised so that its top surface is approximately level with the top surface of the identification card 22. Letters, numbers and/or other indicia are embossed on the room indicia portion 30 so that the location of the patient is recorded when the imprint is made of the identification card 22. As shown in the FIG. 5, the raised room indicia portion 30 is formed by deforming the planer body 24 upward. Depending on the configuration of the impression anvil on which the room jacket 20 will be used, an additional layer 50 of material, such as plastic sheeting similar to that of the identification card 22, may be attached to the backside of the room indicia portion 30 to prevent the portion 30 from being deformed downwardly by the impression roller. The additional layer 50 is preferably added after the embossed indicia are formed on the indicia portion 30.

Referring now to FIG. 6, the stabilizer 36 is shown extending downward from the rear surface of the room jacket 20. The stabilizer 36 is formed by a flap cut free to form the opening 32. The flap may be all or only part of the material cut out to form the opening 32. The stabilizer 36 extends into openings in the imprinting anvil of the imprinting apparatus, as indicated schematically by broken outline. The stabilizer 36 also engages the sides of the universal card holder, as will be discussed in greater detail hereinafter. Some models of imprinting anvils do not have the openings into which the stabilizers 36 and 38 extend and so the room jacket 20 is held only by engaging the universal card holder.

In FIG. 7 is shown an edge view of the room jacket 20 which shows the relationship between the slit forms 26 extending from the top surface of the planar body 24, the stabilizers 36 extending from the rear surface of the planar body 24, and the room indicia portion 30 that lies in a parallel plane above the top surface 42.

Figure 8:
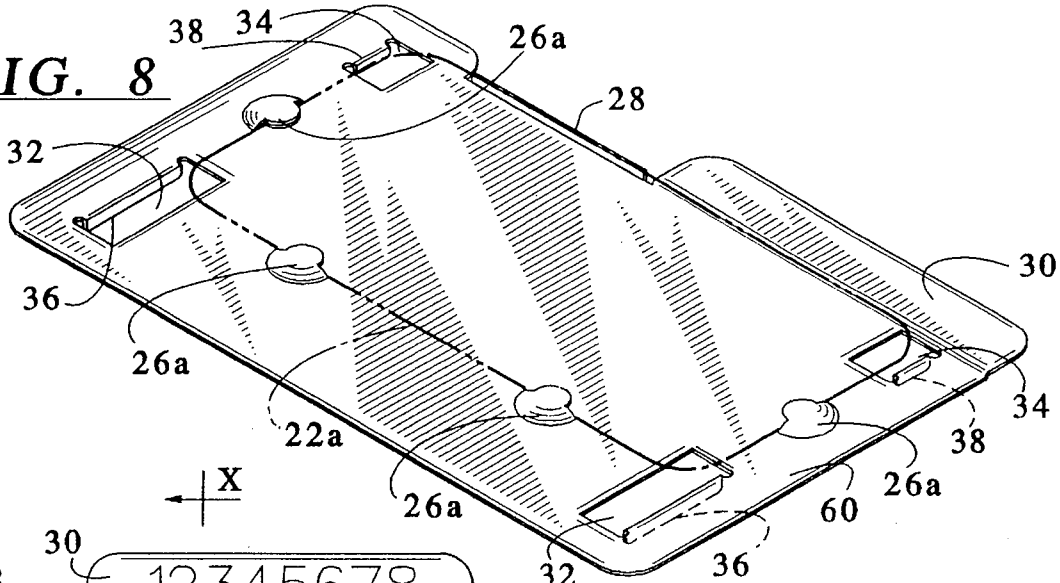
FIG. 8 is a perspective view of a second embodiment of the present room jacket.

In a second embodiment as shown in FIG. 8, the room jacket 60 has the openings 32 and 34, the stabilizers 36 and 38, the raised lip 28 and the room indicia portion 30 in the same arrangement as the first embodiment. The slit forms **26*a* are formed at different positions, however, to accommodate an identification card 22*a* that is of a different, narrower size. The first openings 32 are elongated so that the universal card holder which can engage both the wider card shown in FIG. 1 as well as the narrower card shown in FIG. 8** can be used.

Figure 9:
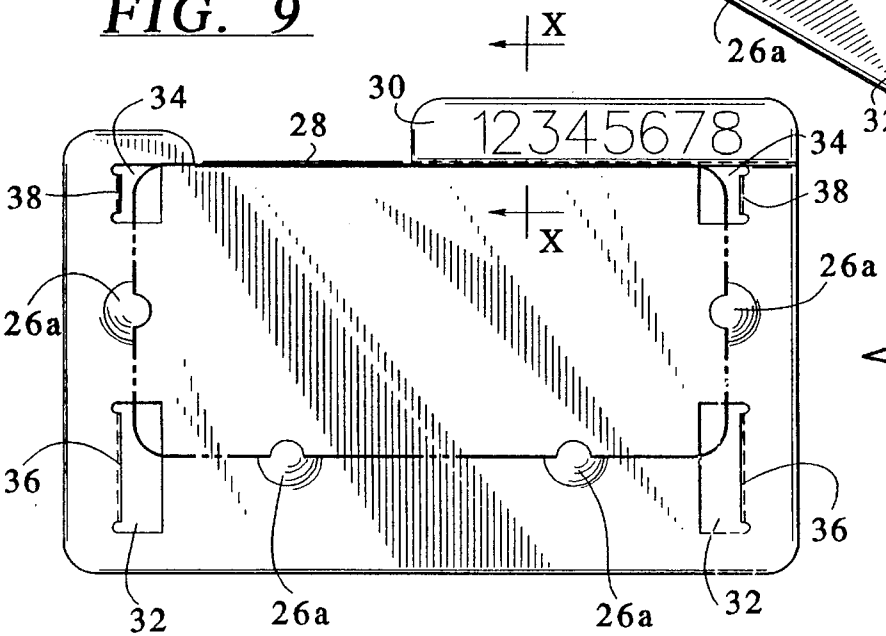
FIG. 9 is a plan view of the room jacket of FIG. 8.

In FIG. 9 can be seen the arrangement of the slit forms **26*a* at the lower edge of the identification card 22*a* at a spacing from the lower edge of the room jacket 60 that is greater than in the embodiment shown in FIG. 2. By comparing these two figures, it can also be seen that the slit forms 26*a* of FIG. 9 at the sides of the card are spaced wider apart from one another and closer to the lateral edges of the room jacket 60 to accommodate the card 22*a* which is slightly longer. The room jacket 60 still extends beyond the edges of the identification card 22*a***, however, to provide stability during imprinting.

Figure 10:
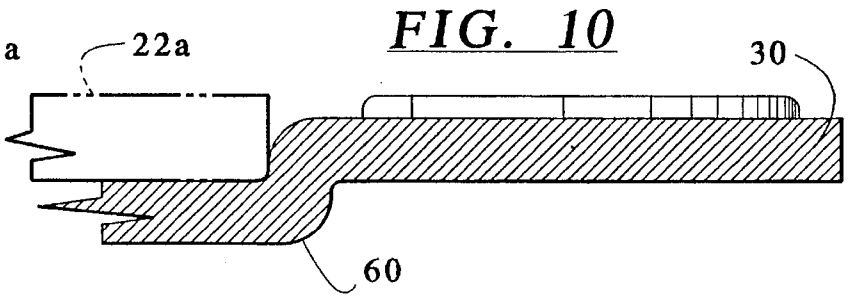
FIG. 10 is an enlarged, fragmentary view of the room jacket of FIG. 9 taken along lines X—X.

FIG. 10 shows the room indicia portion 30 with raised indicia formed thereon and the top edge of the card **22*a*** abutting the edge formed thereby.

Figure 11:
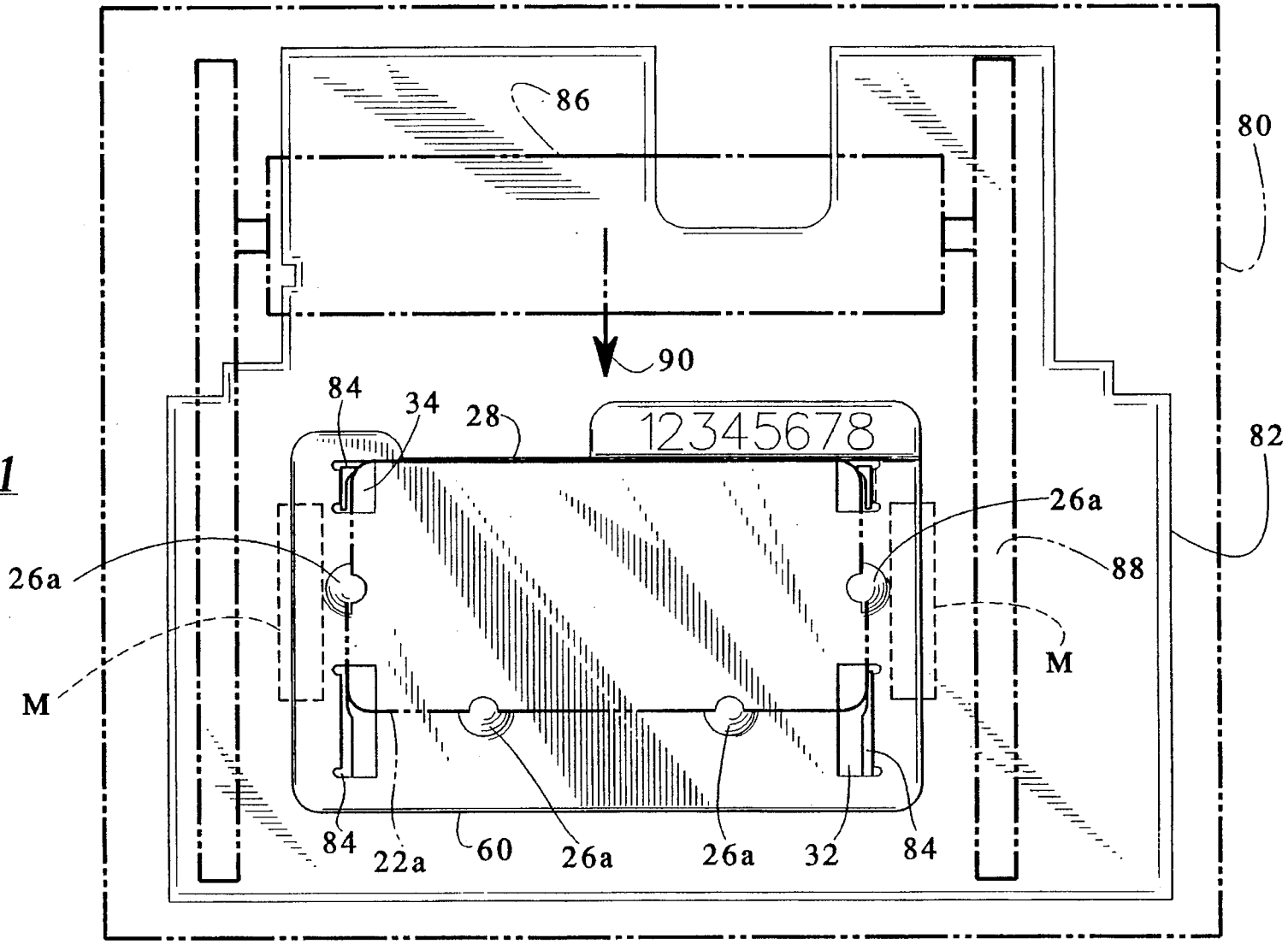
FIG. 11 is a plan view of the room jacket of FIG. 8 shown in place on an anvil of an imprinting apparatus for taking an imprint of the room jacket and an identification card thereon.

FIG. 11 illustrates the use of the present room jacket 60 (in the second embodiment) in an imprinting apparatus. The imprinting apparatus includes a housing 80 within which is an anvil 82 on which the room jacket 60 is placed. The identification card **22*a* has been mounted on the room jacket 60 so that the side edges and lower edge are held in the slit forms 26*a*. A universal card holder 84 is in position below the anvil 82 and has four upwardly extending card engaging fingers that extend through openings in the anvil 82. The room jacket 60 is positioned so that the openings 32 and 34 are over the fingers of the universal card holder 84. The universal card holder 84 engages the edges of the identification card 22*a* to hold it in position, whether the room jacket 60 is used or not. When the room jacket 60 is used, the universal card holder 84 is also held in position thereby. Magnets M hold the jacket 60 on the anvil 82**.

The imprinting apparatus also has an imprinting roller 86, that may be an ink roller or a pressure roller depending on whether pressure sensitive paper is used. The impression roller 86 moves along rails 88 or other movement means in the direction of the arrow 90 when a paper such as a medical records form is placed on the card **22*a* and room jacket 60** so that an imprint of the information embossed thereon is made.

Figure 12:
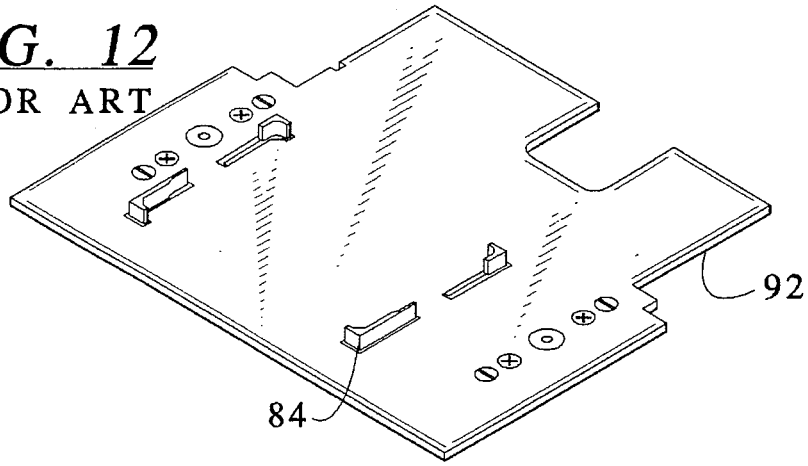
FIG. 12 PRIOR ART
FIG. 12 is a perspective view of the imprinting anvil of FIG. 11.
Figure 14:
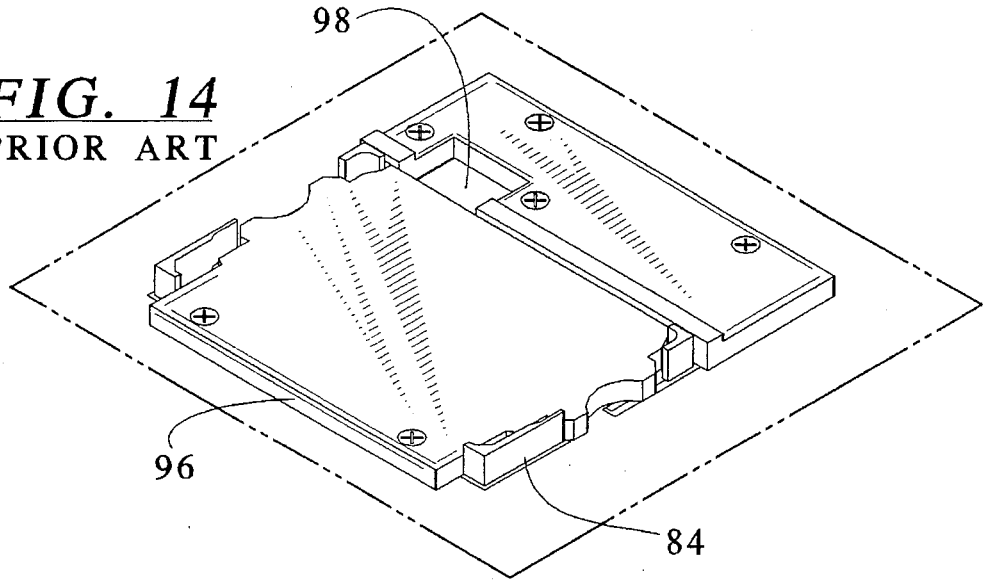
FIG. 14 PRIOR ART
FIG. 14 is a perspective view of the imprinting anvil of a further embodiment of imprinting apparatus with which the present invention will work.
Figure 13:
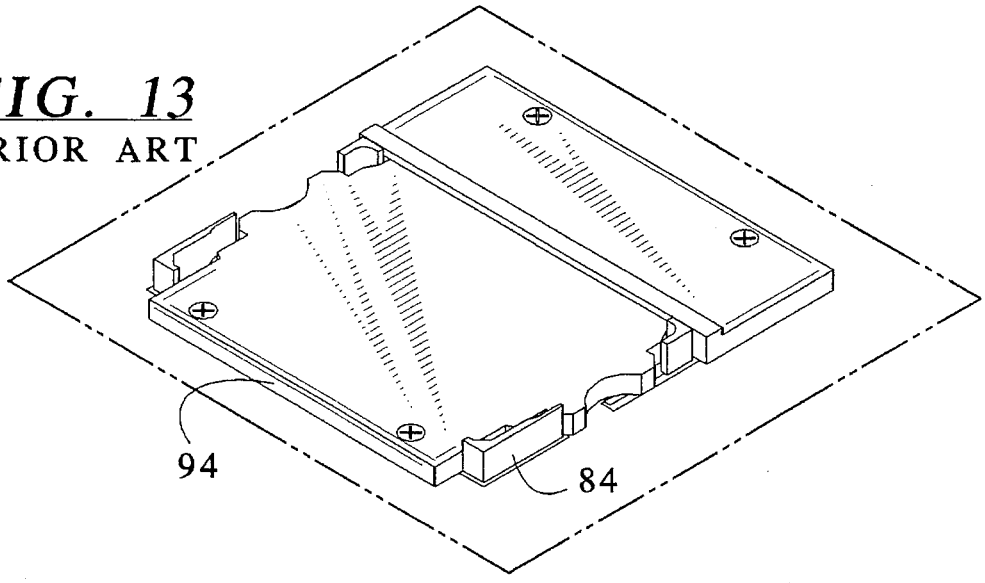
FIG. 13 PRIOR ART
FIG. 13 is a perspective view of the imprinting anvil of another embodiment of imprinting apparatus with which the present invention will work.

Imprinting apparatus are made by several different companies in different models and configurations. FIGS. 12, 13 and 14 show anvils of different imprinting apparatus models. For example, FIG. 12 shows an imprinting anvil 92 of an NBS Card Technology model no. 315 imprinter. The universal card holder 84 fingers extend upward through openings in the anvil 92. The configuration of the universal card holder 84 is such that it engages and holds either the shorter, wider cards shown in FIG. 1 or the longer, narrower cards shown in FIG. 8.

FIG. 13 shows an imprinting anvil 94 of an Addressograph, a Farrington, or a Data Card imprinter. The universal card holder 84 fingers are on the sides of the anvil 94 rather than extending through openings as in FIG. 12. The stabilizers 36 and 38 extend on the sides of the fingers to support the room jacket in this model imprinter.

FIG. 14 shows another imprinting anvil 96 which has an opening 98 for a date imprinter. The present room jacket 20 or 60 has a space above the raised lip 28 and adjacent the room indicia portion 30 for the date imprinter.

The present room jacket may find use as an imprinting backing plate in many different facilities and is not limited to hospitals. Any imprintable cards, such as credit cards and membership cards, may be used with the present card holder jacket.

Although other modifications and changes may be suggested by those skilled in the art, it is the intention of the inventor to embody within the patent warranted hereon all changes and modifications as reasonably and properly come within the scope of his contribution to the art.

I claim:

1. A card holder jacket for use with a card on an anvil of an imprinting apparatus having card edge engaging members projecting perpendicular from an anvil surface, the card having four edges, comprising:

a substantially planar body having an anvil engaging lower surface and a card engaging surface opposite said anvil engaging surface, and having means defining openings for placement over the card edge engaging members so that the card edge engaging members extend through said openings to engage the card;

flaps cut free at three sides at said openings and bent along a fourth side in a first direction extending from said anvil engaging surface, said flaps being a single layer of material, said flaps engaging opposing sides of the card edge engaging members to secure said substantially planar body in position on the anvil relative to the card edge engaging members;

a plurality of card engaging slit forms elevated from said card engaging surface and arranged to engage three edges of the card, said card engaging slit forms being spaced from an edge of said substantially planar body;

a raised tab on said substantially planar body for accepting raised indicia, said raised tab being at a fourth edge of the card when the card is engaged by said card engaging slit forms and including a raised card engaging edge elevated from said card engaging surface for bearing against the fourth edge of the card.

2. A card holder jacket as claimed in claim 1, wherein said substantially planar body defines four openings.

3. A card holder jacket as claimed in claim 2, wherein said flaps comprise four flaps provided on said substantially planar body, one of said flaps being at each of said four openings.

4. A card holder jacket as claimed in claim 1, wherein said substantially planar body is of stainless steel.

5. A card holder jacket as claimed in claim 4, wherein said stainless steel is approximately 0.02 inches thick.

6. A card holder jacket as claimed in claim 1, wherein said substantially planar body is held to the anvil by a magnet.

7. A card holder jacket as claimed in claim 1, wherein said raised tab includes an additional layer of material attached to the anvil engaging surface of the raised tab.

8. A card holder jacket as claimed in claim 7, wherein the additional layer of material is attached after raised indicia have been formed on the raised tab.

9. A card holder jacket as claimed in claim 7, wherein the additional layer of material attached to the anvil engaging surface of the raised tab is plastic sheeting.

10. A card holder jacket adapted for supporting a patient identification card which includes two lateral edges, a top edge and a bottom edge atop a card supporting surface of a printer anvil in an imprinter, a plurality of upwardly projecting fingers of a universal card holder extending to the card supporting surface, such that an imprint of both the patient identification card and the card holder jacket simultaneously is made by the imprinter, the card holder jacket comprising:

a card engaging body being substantially planar for engaging the patient identification card, the card engaging body having an upper edge, a lower edge, two lateral edges and a printer anvil engaging surface;

a room identification tab having a raised edge, located at the upper edge of said card engaging body and raised above a plane of said card engaging body;

a raised lip located at the upper edge of said card engaging body to securely engage the top edge of the patient identification card;

said card engaging body defining a plurality of openings including two first openings and two second openings which are positioned on said card engaging body such that the universal card holder extends upwardly through the first openings and the second openings, engaging the edges of the patient identification card;

two first stabilizers positioned at the first openings and two second stabilizers positioned at the second openings, arranged such that the first stabilizers and the second stabilizers extend downwardly through the plurality of openings in the printer anvil and engage the universal card holder, said two first stabilizers and said two second stabilizers being flaps of material cut free on three edges from respective ones of said first and second openings and bent on a fourth edge;

a plurality of dome-shaped projections, wherein one of said plurality of dome-shaped projections is located on each lateral edge of said card engaging body and two of said dome-shaped projections are located on the lower edge of said card engaging body, said plurality of dome-shaped projections securing the patient identification card such that the patient identification card stays in its position in the card holder jacket when the imprint is taken; and a plurality of rounded tabs, each of said rounded tabs is located on each of said dome-shaped projections, extending over the top edge of the patient identification card.

11. The card holder jacket as claimed in claim 10, wherein said card engaging body is constructed from a magnetically responsive metal.

12. The card holder jacket as claimed in claim 10, further comprising: an additional layer of material attached to the printer anvil engaging surface.

13. The card holder jacket as claimed in claim 10, wherein the two first openings are rectangular.

14. The card holder jacket as claimed in claim 10, wherein the two second openings are square.

* * * * *